US009182714B2

(12) United States Patent
Arizumi et al.

(10) Patent No.: US 9,182,714 B2
(45) Date of Patent: Nov. 10, 2015

(54) FIXING MEMBER, FIXING DEVICE, AND IMAGE FORMING APPARATUS

(71) Applicants: Yuko Arizumi, Kanagawa (JP); Tomoaki Sugawara, Kanagawa (JP); Tsuneaki Kondoh, Kanagawa (JP); Junichiro Natori, Kanagawa (JP)

(72) Inventors: Yuko Arizumi, Kanagawa (JP); Tomoaki Sugawara, Kanagawa (JP); Tsuneaki Kondoh, Kanagawa (JP); Junichiro Natori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/170,726

(22) Filed: Feb. 3, 2014

(65) Prior Publication Data

US 2014/0241770 A1 Aug. 28, 2014

(30) Foreign Application Priority Data

Feb. 22, 2013 (JP) ..... 2013-033502

(51) Int. Cl.
*G03G 15/20* (2006.01)

(52) U.S. Cl.
CPC ..... *G03G 15/206* (2013.01); *G03G 15/2057* (2013.01)

(58) Field of Classification Search
CPC ..... G03G 15/2057
See application file for complete search history.

(56) References Cited

U.S. PATENT DOCUMENTS 5,471,285 A * 11/1995 Nagase et al. ..... 399/168
5,724,638 A * 3/1998 Isogai et al. ..... 399/333
2004/0069404 A1 4/2004 Kondoh
2004/0224165 A1 11/2004 Kondoh et al.
2005/0095381 A1 5/2005 Kondoh
2005/0207806 A1 9/2005 Yoshii et al.
2006/0014021 A1 1/2006 Sugawara et al.
2006/0198666 A1 9/2006 Kondoh et al.
2007/0111873 A1* 5/2007 Ito et al. ..... 492/56
2007/0140758 A1 6/2007 Aze et al.
2008/0069612 A1 3/2008 Nakamura et al.
2008/0213002 A1 9/2008 Katano et al.
2009/0003903 A1 1/2009 Katano et al.
2009/0022527 A1 1/2009 Nakamura et al.
2009/0067868 A1 3/2009 Arizumi et al.
2009/0263584 A1 10/2009 Katano et al.
2009/0324309 A1 12/2009 Nakamura et al.
2010/0119269 A1 5/2010 Kondoh et al.
2010/0129123 A1 5/2010 Natori et al.
2011/0002718 A1 1/2011 Katano et al.
2011/0013957 A1 1/2011 Katano et al.
2011/0217098 A1 9/2011 Tomono et al.
2011/0229231 A1 9/2011 Kaneko et al.
2011/0268480 A1 11/2011 Katano et al.
2012/0135342 A1 5/2012 Katano et al.
2012/0322967 A1 12/2012 Kondoh et al.

FOREIGN PATENT DOCUMENTS

JP 2006-154711 6/2006
JP 2008-191557 8/2008
JP 2008-197585 8/2008
JP 2009-092826 4/2009
JP 2009092826 A * 4/2009
JP 2010-092070 4/2010
JP 2011-227512 11/2011

* cited by examiner

*Primary Examiner* — Clayton E Laballe
*Assistant Examiner* — Leon W Rhodes, Jr.
(74) *Attorney, Agent, or Firm* — Cooper & Dunham LLP

(57) ABSTRACT

A fixing member used for fixing toner includes a base, an elastic layer provided on an outer circumference of the base, and a release layer provided on an outer circumference of the elastic layer. The elastic layer includes silicone rubber, carbon fibers, saturated hydrocarbon having a liquid form at room temperature, and hole portions.

5 Claims, 3 Drawing Sheets

FIXING MEMBER, FIXING DEVICE, AND IMAGE FORMING APPARATUS

CROSS-REFERENCE TO RELATED APPLICATIONS

This patent application is based on and claims priority pursuant to 35 U.S.C. §119 from Japanese Patent Application No. 2013-033502, filed on Feb. 22, 2013 in the Japan Patent Office, which is hereby incorporated by reference herein in its entirety.

BACKGROUND

1. Technical Field

Exemplary embodiments of the present disclosure generally relate to a fixing member, a fixing device, and an image forming apparatus.

2. Related Art

In recent years, electrophotographic image forming apparatuses such as copiers and printers have been directed toward full-color image formation, and the ratio thereof has been gradually increasing. Typically, a color electrophotographic image forming apparatus includes an image forming unit that forms a color image formed of toner images of four colors (cyan, magenta, yellow and black) on a recording medium, and a fixing device that fixes the formed toner images on the recording medium. The fixing device includes a heater for heating the toner images on the recording medium, a fixing member for fixing the toner images onto the recording medium, and a pressing member forming a fixing nip between the pressing member and the fixing member. The toner images are fixed onto the recording medium by heating and pressing the toner images when the recording medium passes through the fixing nip.

The fixing member having a belt shape or a roller shape is known. The fixing member includes those formed by providing an elastic layer made of a heat-resistant rubber on a base member such as a metal roller or a resin seamless belt, and those formed by further providing a release layer on the elastic layer. Generally, a member formed by integrating the heater inside the roller (heat fixing roller) is used as the fixing member having the roller shape. Further, the fixing member having the belt shape providing the heater inside the belt wound around rollers is also well known.

The fixing member needs to flexibly adhere to the toner images and efficiently conduct heat so that toner images (usually toner images of four colors) of multiple colors constituting full color are evenly heated. Thus, silicone rubber having flexibility and heat resistance is often used for the fixing member. However, silicone rubber has low thermal conductivity and thermal conduction to the toner image may become slower.

When thermal conduction to the toner image is slow, a lot of time is required to heat a surface of the fixing member to a fixing temperature for fixing the toner images. In a case of a high-speed machine, supplying of heat may be too slow. In addition, warm-up speed of the image forming apparatus may become slow. It is important to note that the warm-up speed with respect to temperature increase of the fixing member of the fixing device often limits the rate of warm-up speed of the image forming apparatus, as a whole, when powered on.

As a method to resolve the above-described problems, a technique for shortening the warm-up time of an imaging device is disclosed in JP-2008-191557-A, JP-2008-197585-A and JP-2009-092826-A. In the technique, thermal conductivity of the elastic layer is enhanced by blending carbon fibers in silicone rubber, and thermal capacity of the elastic layer is reduced by providing hole portions in silicone rubber. The above-described technique is effective for thermal diffusion. However, a problem of deformation (compressed permanent deformation) that does not easily recover may occur when the elastic layer having a configuration of silicone rubber including the carbon fibers and the hole portions is subjected to pressure over a long period under a stationary condition. When compressed permanent deformation occurs to the fixing member, the fixing member cannot evenly heat the toner images, and uneven gloss of an image or defective image fixing may occur.

As a method to resolve the above-described problem, a method of blending polyhydric alcohol in silicone rubber to enhance resistance to compressed permanent deformation is disclosed in JP-2011-227512-A and JP-4697493-B. However, compatibility of polyhydric alcohol and silicone rubber is poor. En a case of blending polyhydric alcohol to silicone rubber, viscosity increased and restriction to manufacturing conditions occurred as a result. In addition, the above-described method is insufficient to resolve uneven gloss of an image. When silicone rubber having polyhydric alcohol is left under pressure over a long period, compressed permanent deformation occurs to silicone rubber having polyhydric alcohol and uneven gloss of an image occurs.

JP-2006-154711-A describes a fixing member for toner images having a solid material dispersed in a silicone layer instead of a conventional silicone rubber layer provided with hole portions that is a cause for susceptibility to deformation. JP-2006-154711-A also describes lowering viscosity of a silicone resin by adding an organic solvent and blending the solid material when forming the fixing member for toner images. The solid material described in JP-2006-154711-A reduces the amount of heat release of the fixing member and suppresses power consumption, and has low thermal conductivity and good thermal insulation. A typical example is silicone beads. In addition, JP-2006-15471 I-A describes that the organic solvent preferably has a relatively low boiling point such as $C_1$-$C_4$ alcohol, $C_3$-$C_{12}$ hydrocarbon, benzene, toluene, xylene, tetrahydrofuran, acetonitrile, dimethylformamide, or dimethylsulfoxide.

SUMMARY

In view of the foregoing, in an aspect of this disclosure, there is provided a novel fixing member used for fixing toner including a base, an elastic layer provided on an outer circumference of the base, and a release layer provided on an outer circumference of the elastic layer. The elastic layer includes silicone rubber, carbon fibers, saturated hydrocarbon having a liquid form at room temperature, and hole portions.

The aforementioned and other aspects, features, and advantages will be more fully apparent from the following detailed description of illustrative embodiments, the accompanying drawings, and associated claims.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
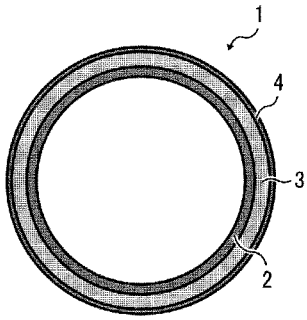
FIG. 1 is a cross-sectional view of one example of a fixing member according to an embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

Hereinafter, exemplary embodiments of the present invention are described in detail with reference to the drawings. However, the present invention is not limited to the exemplary embodiments described below, but can be modified and improved within the scope of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In view of the foregoing, in an aspect of his disclosure, there is provided a novel fixing member that can suppress occurrence of uneven gloss of an image even when the fixing member is left under pressure over a long period, a fixing device, and an image forming apparatus.

Referring now to the drawings, exemplary embodiments of a fixing member, a fixing device, and an image forming apparatus of the present invention are described in detail below.

<Fixing Member>

FIG. 1 is a cross-sectional view of one example of a fixing member according to an embodiment of the present invention. The fixing member according to the present invention may have any shape such as a roller, a belt, or a sheet. As shown in FIG. 1, a fixing member 1 includes a base 2, an elastic layer 3 provided on the outer circumference of the base 2, and a release layer 4 provided on the outer circumference of the elastic layer 3. A primer layer may be provided between individual layers of the fixing member 1 as needed.

(Silicone Rubber)

Figure 2:
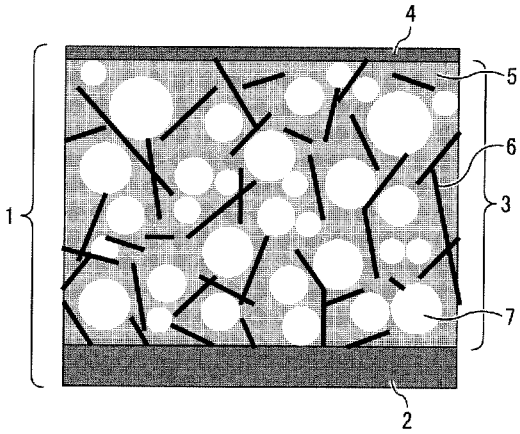
FIG. 2 is an enlarged view of the fixing member according to an embodiment of the present invention.

FIG. 2 is an enlarged view of a fine structure of the example of the fixing member 1 in FIG. 1. The elastic layer 3 is configured of silicone rubber 5, carbon fibers 6, hole portions 7, and saturated hydrocarbon (not shown in FIG. 2).

There is no restriction regarding the employed silicone rubber for silicone rubber 5 as long as the employed silicone rubber includes an organosiloxane structure. Specific examples of the silicone rubber include, but are not limited to, KE-1950-30 (from Shin-Etsu Chemical Co., Ltd.) and DY35-2083 (from Dow Corning Toray Co., Ltd.). Among silicone rubbers, an addition-type liquid silicone rubber having a hardening temperature ranging from approximately 90° C. to 140° C. offers excellent workability and is preferable.

(Carbon Fibers)

Carbon fibers 6 may be obtained by carbonizing a precursor (raw material of carbon fibers formed into fibers), Carbon fibers 6 include pitch-based carbon fibers and PAN-based (polyacrylonitrile) carbon fibers depending on manufacturing conditions. Specific examples of pitch-based carbon fibers include, but are not limited to, GRANOC (R) XN-100-05M and XN-100-15M (from Nippon Graphite Fiber Corporation); DIALEAD (R) K223QM, K636IM, and K223HM (from Mitsubishi Plastics, Inc.); and DONACARBO Middle S-2404, S-249, S-241, and SG-249 (from Osaka Gas Chemicals Co., Ltd.). Specific examples of PAN-based carbon fibers include, but are not limited to, TORAYCA (R) Milled Fibers MLD-30, MLD-300, and MLD-1000 (from Toray Industries, Inc.); and PYROFIL (R) Chopped Fibers (from Mitsubishi Rayon Co., Ltd.). Pitch-based carbon fibers have superior thermal conductivity compared to PAN-based carbon fibers and are preferable. In addition, a carbon nanotube having a large aspect ratio can also be employed as carbon fibers 6.

An addition amount of carbon fibers 6 is preferably a range from 1 part by weight to 60 parts by weight with respect to 100 parts by weight of silicone rubber, and more preferably in a range from 5 parts by weight to 50 parts by weight. When the addition amount is less than 1 part by weight, no enhancement in thermal conductivity is exhibited. When the addition amount is more than 60 parts by weight, strength and surface property (surface roughness) of the formed fixing member 1 declines and is not preferable.

(Hole Portions)

The hole portions 7 may be formed with a foaming agent or a foaming particle. Specific examples of the foaming agent include, but are not limited to, sodium hydrogen carbonate, azobisisobutyronitrile, and water. Specific examples of the foaming particle include, but are not limited to, Matsumoto Microsphere (R) F-30, F-36, F-50, F-55, FN-80SDE, F-65DE, and F-80DE (from Matsumoto Yushi-Seiyaku Co., Ltd.); and Expan (R) 053-40, 031-40, 551DE40d42, 920DE40d30, and EMC40(B) (from Japan Fillite Co., Ltd.). The foaming agents and the foaming particles expand and form the hole portions 7 when the elastic layer 3 is heat-molded. Further, unexpanded foaming particles may be expanded to form pre-foamed particles and then blended to the elastic layer 3. The pre-foamed particles are preferable because the pre-foamed particles have already expanded, and shape and volume of the pre-foamed particles are difficult to change during a molding process and excellent dimensional accuracy is obtained.

An addition amount of a foaming material for forming the hole portions is preferably in a range from 0.1 parts by weight to 5 parts by weight with respect to 100 parts by weight of the silicone rubber, and more preferably in a range from 0.5 parts by weight to 3 parts by weight. When the addition amount is less than 0.1 parts by weight, no decrease in thermal capacity is exhibited. When the addition amount is more than 5 parts by weight, strength and surface property (surface roughness) of the formed fixing member 1 declines and is not preferable.

(Saturated Hydrocarbon)

Chain saturated hydrocarbon or cyclic saturated hydrocarbon may be used as the saturated hydrocarbon. Specific examples of the saturated hydrocarbon include, but are not limited to, cyclooctane (boiling point of 149° C.), nonane (boiling point of 151° C.), decane (boiling point of 174° C.), isodecane (boiling point of 166° C.), cyclodecane (boiling point of 201° C.), undecane (boiling point of 196° C.), dodecane (boiling point of 216° C.), isododecane (boiling point of 177° C.), tridecane (boiling point of 235° C.), tetradecane (boiling point of 253° C.), pentadecane (boiling point of 270° C.), hexadecane (boiling point of 287° C.), pentadecane (boiling point of 303° C.), octadecane (boiling point of 317° C.), nonadecane (boiling point of 330° C.). Saturated hydrocarbon is preferable because saturated hydrocarbon has low reactivity and is stable, has good compatibility with silicone rubber, and does not influence hardening of silicone rubber. Among saturated hydrocarbons, saturated hydrocarbons having 19 or less carbon atoms are preferable because saturated hydrocarbons having 19 or less carbon atoms do not bleed out between the elastic layer 3 and the release layer 4, and weaken the adhesion strength between the elastic layer 3 and the release layer 4.

Further, among saturated hydrocarbons, saturated hydrocarbons having a liquid form at room temperature are preferable because saturated hydrocarbons having a liquid form at room temperature have good compatibility with silicone rubber and disperse uniformly.

Conventionally, saturated hydrocarbon is blended as a viscosity modifier of silicone rubber. Normally, saturated hydrocarbon is vaporized during a molding process of silicone rubber, and an extremely minute amount of saturated hydrocarbon remains in the molded silicone rubber. Thus, an effect of suppressing compressed permanent deformation of silicone rubber is not exhibited. By contrast, saturated hydrocarbon according to the present invention preferably has a boiling point higher than a molding temperature of the elastic layer 3, and thus remains in the elastic layer 3 after molding. Accordingly, an effect of suppressing compressed permanent deformation of the fixing member 1 is exhibited.

An addition amount of saturated hydrocarbon is preferably a range from 0.5 parts by weight to 50 parts by weight with respect to 100 parts by weight of the silicone rubber, and more preferably in a range from 1 part by weight to 25 parts by weight. When the addition amount is less than 0.5 parts by weight, no suppressing effect of compressed permanent deformation is exhibited. When the addition amount is more than 50 parts by weight, separation and bleed out of a blended material due to a viscosity decline occurs and is not preferable.

(Other Raw Materials for Elastic Layer Composition)

The composition of the elastic layer 3 may be adjusted by mixing, kneading, and dispersing carbon fibers 6, a material for forming the hole portions 7, and saturated hydrocarbon with silicone rubber. A publicly known cross-linking agent, filler, conductive agent, degradation preventing agent for rubber and plastic materials, and heat-resistant agent may be added to the elastic layer 3 according to objective as long as the effect of the present invention is not impaired.

(Formation of Elastic Layer)

There is no restriction regarding a method for forming the elastic layer 3 and may be arbitrarily selected according to objective.

For example, a method of coating the elastic layer 3 constituents by blade coating, die coating, and dip coating and hardening the elastic layer 3 constituents with heat or electron beam may be used.

A film thickness of the elastic layer 3 is preferably in a range from approximately 0.1 min to approximately 4 mm, and more preferably in a range from approximately 0.2 mm and approximately 2 mm. When the film thickness is less than 0.1 mm, a sufficient fixing nip width may not be formed.

Further, when the film thickness is more than 4 mm, decline in thermal conductivity or enhancement in thermal capacity occurs and speeding up of the image forming apparatus or swiftness of warm-up time may be influenced.

Specific examples of a material for the base 2 include, but are not limited to, a resin such as polyimide, polyamideimide, polyether ether ketone, polyether sulfone, polyphenylene sulfide, and fluororesin; a resin obtained by dispersing magnetic conductive particles in one of the above-described resins; a metal such as nickel, stainless steel, iron, aluminum, and copper; and an alloy of the above-described metals.

There is no restriction regarding a method for forming the base 2, and may be arbitrarily selected according to objective.

For example, a method of molding the material for the base 2 with a mold may be employed.

A layer thickness of the base 2 is preferably in a range from approximately 30 μm to approximately 500 μm, and more preferably in a range from approximately 50 μm to approximately 150 μm. When the film thickness is less than 30 μm, decline in strength of the base 2 may occur. When the film thickness is more than 500 μm, enhancement of thermal capacity occurs and speeding up of the image forming apparatus or swiftness of warns-up time may be influenced.

A fluororesin may be employed as the release layer 4. Specific examples of the fluororesin include, but are not limited to, low molecular weight polytetrafluoroethylene (PTFE), tetrafluoroethylene/hexafluoropropylene copolymer (FEP), and tetrafluorothylene/perfluoroalkyl-vinylether copolymer (PFA). Specific examples of PTFE include, but are not limited to, LUBRON L-5 and L-2 (from Daikin Industries, Ltd.); and MP1100, MP1200, MP1300, and TLP-10E-1 (from DuPont-Mitsui Fluorochemicals, Co., Ltd.). Specific examples of the FEP include, but are not limited to, 532-8000 (from DuPont). Specific examples of PFA include, but are not limited to, AC-5600 and AC5539 (from Daikin Industries, Ltd.); and MP-102, MP-103, MP-300, and 950HP-Plus (from DuPont-Mitsui Fluorochemicals, Co., Ltd.). Specific examples of PFA-FEP include, but are not limited to, SMT (from Gunze Limited). A fluororesin having a relatively low melting point (preferably, in a range from approximately 250° C. to approximately 300° C.) offers good workability and is preferable. In addition, fluorosilicone rubber may be used for the release layer 4.

There is no restriction regarding a method for forming the release layer 4, and may be arbitrarily selected according to objective.

For example, a method of forming the material of the release layer 4 into a tube shape and covering the elastic layer 3, or a method of firing after wet spray coating or particle coating the material of the release layer 4 may be employed.

A film thickness of the release layer 4 is preferably in a range from approximately 1 μm to approximately 100 μm, and more preferably in a range from approximately 10 μm to approximately 100 μm. When the film thickness is less than 1 μm, durability of the release layer 4 is poor and obtaining a sufficiently smooth surface of the fixing member 1 becomes difficult. By contrast, when the film thickness is more than 100 μm, decline in image following capability and enhancement of heat transfer resistance may occur and is not preferable.

<Fixing Device>

Figure 3:
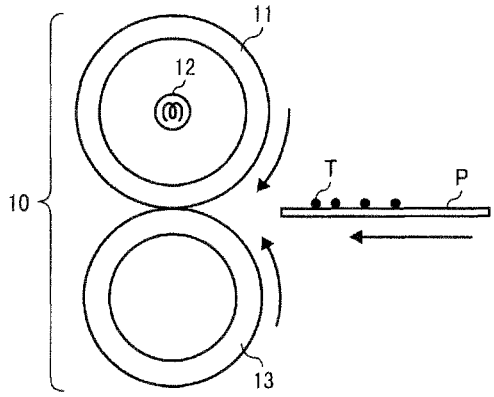
FIG. 3 is a schematic view of a fixing device (roller type) according to an embodiment of the present invention.

FIG. 3 is a schematic view of a configuration of a fixing device (roller type) according to an embodiment of the present invention. In FIG. 3, a roller-type fixing device 10 includes a heater 12 such as a halogen lamp serving as a heater inside a fixing roller 11 serving as a fixing member of the present invention. A temperature sensor (not shown in FIG. 3) is provided in a fixing roller 11. A pressure roller 13 presses and contacts the fixing roller 11 and forms a nip portion. A recording medium P having a toner image T passes through the nip portion and the toner image T is fixed on the recording medium P. The fixing roller 11 includes an elastic layer and a release layer provided on a surface of a cored bar serving as a base in a sequence of the elastic layer and the release layer, and has the same configuration as the fixing member 1 shown in FIG. 1 and FIG. 2. The pressure roller 13 includes an elastic layer and a release layer formed of a heat-resistant rubber provided on a surface of a cored bar serving as a base in a sequence of the elastic layer and the release layer.

Figure 4:
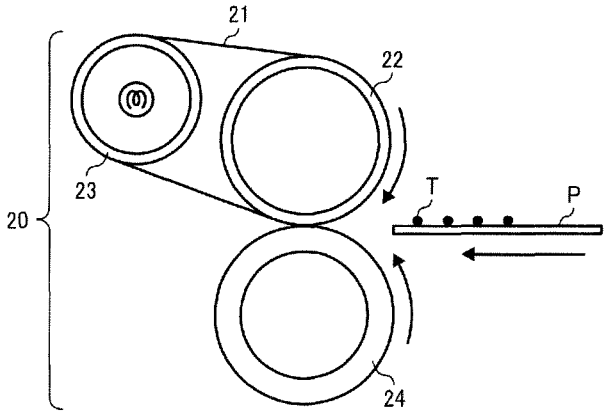
FIG. 4 is a schematic view of one example of a fixing device (belt type) according to an embodiment of the present invention.

The fixing device according to the present invention may have a configuration of a fixing device (belt type) shown in FIG. 4.

A belt-type fixing device 20 is configured of a fixing belt 21 serving as a fixing member according to the present invention, a fixing roller 22, a heating roller 23, and a pressure roller 24. The fixing belt 21 is stretched and supported by the fixing roller 22 and the heating roller 23. The pressure roller 24 presses and contacts the fixing belt 21 and forms a nip portion. A recording medium P having a toner image T passes through the nip portion and the toner image T is fixed on the recording medium P.

The fixing device of the present invention employs the fixing member according to the present invention, and thus can suppress occurrence of uneven gloss of an image even when the fixing member is left under pressure over a long period.

<Image Forming Apparatus>

Figure 5:
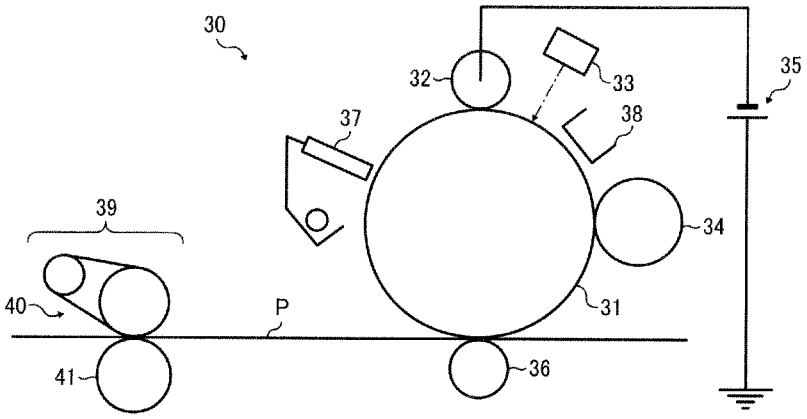
FIG. 5 is a schematic view of one example of an image forming apparatus according to an embodiment of the present invention.

FIG. 5 is a schematic view of one example of a configuration of an image forming apparatus according to an embodiment of the present invention. In FIG. 5, an image funning apparatus 30 includes an image forming unit for forming a toner image and transferring the toner image onto a recording medium, and a fixing device for fixing the image transferred onto the recording medium. The image forming unit includes an image carrier 31 on which a latent image is formed, a charging roller 32 that contacts the image carrier 31 and conducts charging, an exposure device 33 such as a laser beam, a developing roller 34 that attaches toner to the electrostatic latent image formed on the image carrier 31, a power supply 35 that applies a DC voltage to the charging roller 32, a transfer roller 36 that performs transferring process of the toner image on the image carrier 31 onto a recording medium P, a cleaning device 37 that cleans the image carrier 31 after transferring process, and a surface potentiometer 38 that measures a surface potential of the image carrier 31. The fixing device 39 is the fixing device according to the present invention and is configured of a fixing belt 40 and a pressure roller 41.

In the embodiment of the present invention shown in FIG. 5, the image forming apparatus 30 conducts uniform charging of a photosensitive layer of the rotating image carrier 31 with the charging roller 32, forms an electrostatic latent image on the photosensitive layer by exposing the photosensitive layer with the exposure device 33 such as a laser beam, develops the electrostatic latent image by attaching toner to form a toner image with the developing roller 34, and transfers the toner image onto the recording medium P. The recording medium P having the transferred toner image is pressed and contacted at a nip portion formed between the fixing belt 40 and the pressure roller 41 of the fixing device 39, and the toner image on the recording medium P is fixed onto the recording medium P by softening the toner image by heat of the fixing belt 40 and application of pressure. The recording medium P is then discharged to a discharging member. The fixing member according to the present invention is preferably used as the fixing belt 40. It is to be noted that in the schematic view of the configuration in FIG. 5, the fixing member has a belt shape, but in the present invention the fixing member may also take a roller shape as described above.

The image forming apparatus according to the present invention employs the fixing device according to the present invention and can suppress occurrence of uneven gloss of an image even when the fixing member is left under pressure over a long period.

EXAMPLES

Further understanding can be obtained by reference to specific examples, which are provided hereinafter. However, it is to be understood that the embodiments of the present invention are not limited to the following examples.

Example 1

An elastic layer composition is prepared by dispersing 100 parts by weight of silicone rubber (DY35-2083 from Dow Corning Toray Co., Ltd.), 45 parts by weight of carbon fibers (GRANOC (R) XN-100-05M from Nippon Graphite Fiber Corporation), 1.0 part by weight of foaming particles (Matsumoto Microsphere (R) F-65DE from Matsumoto Yushi-Seiyaku Co., Ltd.), and 15 parts by weight of isododecane (boiling point of 177° C.).

A primer for silicone is coated on a polyimide base having a tubular shape (60 mm in diameter, 50 μm in thickness) and dried. Next, the elastic layer composition is coated on the primer for silicone of the polyimide base, heated and hardened for 10 minutes at a temperature of 130° C., and an elastic layer having a thickness of 300 μm is formed. Next, the primer for silicone is coated on the elastic layer. The elastic layer having the primer for silicone coat is covered with a fluororesin tube (SMT from Gunze Limited) and heated for four hours at a temperature of 200° C. A release layer having a thickness of 20 μm is formed. A fixing member of Example 1 is prepared.

The fixing member of Example 1 obtained as described above is set in a fixing device of an image forming apparatus (Imagio MPC3000 from RICOH Company, Ltd.) and left for five days in a state of a pressure roller contacting and pressing the fixing member. Next, the fixing device is set in the image forming apparatus (Imagio MPC3000 from RICOH Company, Ltd.) and a test of passing through 100 sheets of a recording medium having a solid image is conducted. The employed recording medium is multipaper super white (from Askul Co., Ltd.). Gloss unevenness of the solid images of a first sheet and a 100th sheet of the recording medium is evaluated visually and ranked.

Example 2

An elastic layer composition is prepared by dispersing 100 parts by weight of silicone rubber (DY35-2083 from Dow Corning Toray Co., Ltd.), 45 parts by weight of carbon fibers (GRANOC (R) XN-100-05M from Nippon Graphite Fiber Corporation), 1.0 part by weight of foaming particles (Matsumoto Microsphere (R) F-65DE from Matsumoto Yushi-Seiyaku Co., Ltd.), and 15 parts by weight of cyclodecane (boiling point of 201° C.).

A primer for silicone is coated on a polyimide base having a tubular shape (60 mm in diameter, 50 μm in thickness) and dried. Next, the elastic layer composition is coated on the primer for silicone of the polyimide base, heated and hardened for 10 minutes at a temperature of 130° C., and an elastic layer having a thickness of 300 μm is formed. Next, the primer for silicone is coated on the elastic layer. The elastic layer having the primer for silicone coat is covered with a fluororesin tube (SMT from Gunze Limited) and heated for four hours at a temperature of 200° C. A release layer having a thickness of 20 μm is formed. A fixing member of Example 2 is prepared.

Evaluation of gloss unevenness of solid images in Example 1 is repeated for the fixing member of Example 2 obtained as described above.

Example 3

An elastic layer composition is prepared by dispersing 100 parts by weight of silicone rubber (DY35-2083 from Dow Corning Toray Co., Ltd.), 50 parts by weight of carbon fibers (GRANOC (R) XN-100-05M from Nippon Graphite Fiber Corporation), 1.5 parts by weight of foaming particles (Matsumoto Microsphere (R) FN-80SDE from Matsumoto Yushi-Seiyaku Co., Ltd.), and 10 parts by weight of dodecane (boiling point of 216° C.).

A primer for silicone is coated on a polyimide base having a tubular shape (60 mm in diameter, 50 μm in thickness) and dried. Next, the elastic layer composition is coated on the primer for silicone of the polyimide base, heated and hardened for 10 minutes at a temperature of 130° C., and an elastic layer having a thickness of 300 μm is formed. Next, the primer for silicone is coated on the elastic layer. The elastic layer having the primer for silicone coat is covered with a fluororesin tube (SMT from Gunze Limited) and heated for four hours at a temperature of 200° C. A release layer having a thickness of 20 μm is formed. A fixing member of Example 3 is prepared.

Evaluation of gloss unevenness of solid images in Example 1 is repeated for the fixing member of Example 3 obtained as described above.

Example 4

An elastic layer composition is prepared by dispersing 100 parts by weight of silicone rubber (DY35-2083 manufactured by Dow Corning Toray Co., Ltd.), 40 parts by weight of carbon fibers (DIALEAD (R) K223HM having an average fiber length of 50 μm from Mitsubishi Plastics, Inc.), 1.2 parts by weight of foaming particles (Matsumoto Microsphere (R) FN-80SDE from Matsumoto Yushi-Seiyaku Co., Ltd.), and 5 parts by weight of tetradecane (boiling point of 253° C.).

A primer for silicone is coated on a polyimide base having a tubular shape (60 mm in diameter, 50 μm in thickness) and dried. Next, the elastic layer composition is coated on the primer for silicone of the polyimide base, heated and hardened for 10 minutes at a temperature of 130° C., and an elastic layer having a thickness of 200 μm is formed. Next, the primer for silicone is coated on the elastic layer. The elastic layer having the primer for silicone coat is covered with a fluororesin tube (SMT from Gunze Limited) and heated for four hours at a temperature of 200° C. A release layer having a thickness of 20 μm is formed. A fixing member of Example 4 is prepared.

Evaluation of gloss unevenness of solid images in Example 1 is repeated for the fixing member of Example 4 obtained as described above.

Example 5

An elastic layer composition is prepared by dispersing 100 parts by weight of silicone rubber (DY35-2083 from Dow Corning Toray Co., Ltd.), 40 parts by weight of carbon fibers (DONACARBO Middle S-249 from Osaka Gas Chemicals Co., Ltd.), 1.2 parts by weight of foaming particles (Expan (R) 920DE40d30 from Japan Fillite Co., Ltd.), and 2 parts by weight of hexadecane (boiling point of 287° C.).

A primer for silicone is coated on a polyimide base having a tubular shape (60 mm in diameter, 50 μm in thickness) and dried. Next, the elastic layer composition is coated on the primer for silicone of the polyimide base, heated and hardened for 10 minutes at a temperature of 130° C., and an elastic layer having a thickness of 200 μm is formed. Next, the primer for silicone is coated on the elastic layer. The elastic layer having the primer for silicone coat is covered with a fluororesin tube (SMT from Gunze Limited) and heated for four hours at a temperature of 200° C. A release layer having a thickness of 20 μm is formed. A fixing member of Example 5 is prepared.

Evaluation of gloss unevenness of solid images in Example 1 is repeated for the fixing member of Example 5 obtained as described above.

Comparative Example 1

An elastic layer composition is prepared by dispersing 100 parts by weight of silicone rubber (DY35-2083 from Dow Corning Toray Co., Ltd.), 45 parts by weight of carbon fibers (GRANOC (R) XN-100-05M from Nippon Graphite Fiber Corporation), and 1.0 part by weight of foaming particles (Matsumoto Microsphere (R) F-65DE from Matsumoto Yushi-Seiyaku Co., Ltd.).

A primer for silicone is coated on a polyimide base having a tubular shape (60 mm in diameter, 50 μm in thickness) and dried. Next, the elastic layer composition is coated on the primer for silicone of the polyimide base, heated and hardened for 10 minutes at a temperature of 130° C., and art elastic layer having a thickness of 300 μm is formed. Next, the primer for silicone is coated on the elastic layer. The elastic layer having the primer for silicone coat is covered with a fluororesin tube (SMT from Gunze Limited) and heated for four hours at a temperature of 200° C. A release layer having a thickness of 20 μm is formed. A fixing member of Comparative example 1 is prepared.

Evaluation of gloss unevenness of solid images in Example 1 is repeated for the fixing member of Comparative example 1 obtained as described above.

Comparative Example 2

An elastic layer composition is prepared by dispersing 100 parts by weight of silicone rubber (DY35-2083 from Dow Corning Toray Co., Ltd.), 45 parts by weight of carbon fibers (GRANOC (R) XN-100-05M from Nippon Graphite Fiber Corporation), 1.0 part by weight of foaming particles (Matsumoto Microsphere (R) F-65DE from Matsumoto Yushi-Seiyaku Co., Ltd.), and 15 parts by weight of octane (boiling point of 126° C.).

A primer for silicone is coated on a polyimide base having a tubular shape (60 mm in diameter, 50 μm in thickness) and dried. Next, the elastic layer composition is coated on the primer for silicone of the polyimide base, heated and hardened for 10 minutes at a temperature of 130° C. The heated and hardened elastic layer composition is further subjected to heat at a temperature of 200° C. for four hours and an elastic layer having a thickness of 300 μm is formed. Next, the primer for silicone is coated on the elastic layer. The elastic layer having the primer for silicone coat is covered with a fluororesin tube (SMT from Gunze Limited) and heated for four hours at a temperature of 200° C. A release layer having a thickness of 20 μm is formed. A fixing member of Comparative example 2 is prepared.

Evaluation of gloss unevenness of solid images in Example 1 is repeated for the fixing member of Comparative example 2 obtained as described above.

Evaluation results are shown in Table 1. Evaluation method and evaluation criteria are as follows.

Rank 1: Uneven gloss is seen, and is an abnormal image. Evaluated as poor.

Rank 2: Uneven gloss is seen though is within an allowable level (not an abnormal image). Evaluated as good.

Rank 3: Uneven gloss is not seen. Evaluated as good.

TABLE 1

| | Rank of first sheet of the recording medium | Rank of 100th sheet of the recording medium |
|---|---|---|
| Example 1 | 2 | 3 |
| Example 2 | 3 | 3 |
| Example 3 | 3 | 3 |
| Example 4 | 3 | 3 |
| Example 5 | 3 | 3 |
| Comparative example 1 | 1 | 1 |
| Comparative example 2 | 1 | 1 |

According to the foregoing, the occurrence of uneven gloss of the solid image is suppressed from the first sheet for the fixing members of Examples 1 to 5 even when the fixing members are left under pressure over a long period. By contrast, uneven gloss of the solid image is seen from the first sheet and the $100^{th}$ sheet for the fixing members of Comparative examples 1 and 2. Accordingly, the fixing member according to the present invention having saturated hydrocarbon is resistant to compressed permanent deformation and can suppress the occurrence of uneven gloss of the solid image.

In view of the foregoing, there is provided a fixing member that is resistant to compressed permanent deformation even when the fixing member is left under pressure over a long period and can suppress occurrence of uneven gloss of an image, a fixing device, and an image forming apparatus.

What is claimed is:

1. A fixing member used for fixing toner, comprising:

a base;

an elastic layer provided on an outer circumference of the base; and a release layer provided on an outer circumference of the elastic layer;

wherein the elastic layer includes silicone rubber, carbon fibers, saturated hydrocarbon having a liquid form at room temperature, and hole portions, and wherein the saturated hydrocarbon that has a liquid form at room temperature is selected from the group consisting of cyclooctane nonane, decane, isodecane, cyclodecane, undecane, dodecane, isododecane, tridecane, tetradecane, pentadecane, hexadecane, pentadecane, octadecane, and nonadecane.

2. The fixing member of claim 1, wherein the saturated hydrocarbon has a boiling point of 200° C. or more.

3. A fixing device comprising the fixing member of claim 1.

4. An image forming apparatus comprising the fixing device of claim 3.

5. The fixing member of claim 1, wherein the saturated hydrocarbon that has a liquid form at room temperature is selected from the group consisting of isodecane, cyclodecane, dodecane, tetradecane, and hexadecane.

* * * * *